US006097674A

United States Patent [19]

Swapp

[11] Patent Number: 6,097,674

[45] Date of Patent: Aug. 1, 2000

[54] METHOD FOR MEASURING TIME AND STRUCTURE THEREFOR

[75] Inventor: Mavin C. Swapp, Gilbert, Ariz.

[73] Assignee: Motorola, Inc., Schaumburg, Ill.

[21] Appl. No.: 09/069,426

[22] Filed: Apr. 29, 1998

Related U.S. Application Data

[62] Division of application No. 08/550,055, Oct. 30, 1995.

[51] Int. Cl.[7] ..... G04F 8/00; G04F 10/00

[52] U.S. Cl. ..... 368/113; 368/120

[58] Field of Search ..... 368/113–120; 364/569; 377/20

[56] References Cited

U.S. PATENT DOCUMENTS

| | | | |
|---|---|---|---|
| 3,668,529 | 6/1972 | Meyer | 328/129 |
| 4,090,191 | 5/1978 | Kinbara | 340/347 |
| 4,303,983 | 12/1981 | Chaborski | 364/569 |
| 4,470,082 | 9/1984 | Van Pelt et al. | 360/51 |
| 4,613,951 | 9/1986 | Chu | 364/569 |
| 4,731,762 | 3/1988 | Hanks | 367/108 |
| 4,745,310 | 5/1988 | Swapp | 307/603 |
| 4,943,787 | 7/1990 | Swapp | 331/2 |
| 4,972,413 | 11/1990 | Littlebury et al. | 371/22.1 |
| 5,020,038 | 5/1991 | Swapp et al. | 368/120 |
| 5,063,311 | 11/1991 | Swapp | 307/603 |
| 5,063,312 | 11/1991 | Barbu et al. | 307/603 |
| 5,121,012 | 6/1992 | Orlov | 307/517 |
| 5,175,452 | 12/1992 | Lupi et al. | 307/591 |
| 5,199,008 | 3/1993 | Lockhart et al. | 368/117 |
| 5,263,012 | 11/1993 | Muirhead | 368/119 |
| 5,317,219 | 5/1994 | Lupi et al. | 307/603 |

*Primary Examiner*—Vit Miska
*Attorney, Agent, or Firm*—Ziye Zhou

[57] ABSTRACT

A time measurement circuit (100) measures a time interval between two events. The time measurement circuit (100) includes two digital phase counters (10' and 10"), a period counter (210), and a digital calculator (310). The first digital phase counter (10') converts a time interval from a leading edge of a start signal to a leading edge of clock signal following the start signal into a first binary number. The second digital phase counter (10") converts a time interval from a leading edge of a stop signal to a leading edge of clock signal following the stop signal into a second binary number. The period counter (210) converts a time interval between the two leading edges of the clock signal into a third binary number. The digital calculator (310) combines the three binary numbers to generate a number representing the time interval between the start signal and the stop signal.

20 Claims, 3 Drawing Sheets

METHOD FOR MEASURING TIME AND STRUCTURE THEREFOR

The present application is based on prior US application Ser. No. 08/550,055 filed on Oct. 30, 1995, which is hereby incorporated by reference, and priority thereto for common subject matter is hereby claimed.

BACKGROUND OF THE INVENTION

The present invention relates, in general, to measuring time, and more particularly, to measuring a time interval between two events using a time to digital converter.

In some applications such as electronic circuit testing, radar ranging, and elementary particle physics, it is often indispensable to be able to measure time at a very high resolution. To achieve a resolution finer than the period of a clock signal, a common approach uses an analog ramp circuit. The analog ramp circuit generates voltage ramp signals, which are used in conjunction with the clock signal to measure a time interval between a start signal and a stop signal. More particularly, the start signal activates a first ramp circuit, which in turn generates a first voltage ramp signal. The voltage increases until the first ramp circuit is deactivated by a leading edge of the clock signal following the start signal. At some time after the start signal, the stop signal activates a second ramp circuit, which in turn generates a second voltage ramp signal. The voltage increases until the second ramp circuit is deactivated by a leading edge of the clock signal following the stop signal. The slope of the each voltage ramps is equal to the rate of the voltage increase with respect to time. The duration of the first voltage ramp and the duration of the second voltage ramp are calculated by dividing the voltage excursions of the first and second voltage ramps by their respective slopes. In addition, the time duration between the leading edge of the clock signal following the start signal and the leading edge of the clock signal following the stop signal is calculated using a counter. This duration is referred to as a clocking interval. The time interval between the start signal and the stop signal is calculated by subtracting the duration of the second voltage ramp from the sum of the duration of the first voltage ramp and the clocking interval.

Circuits used for generating and sensing linear voltage ramps are typically large and complex, and are, therefore, expensive to manufacture on a monolithic integrated circuit. Furthermore, the circuits are not sufficiently accurate for some high resolution measurements. In addition, the cost of building measuring devices using the analog ramp circuits is usually high.

Accordingly, it would be advantageous to have a simple and inexpensive circuit for measuring time and achieving a resolution finer than the period of a clock signal. It is also desirable for the circuit to convert the measured time to a digital value quickly and accurately. It would be of further advantage for the circuit to be sufficiently small to be manufactured as a monolithic integrated circuit.

DETAILED DESCRIPTION OF THE DRAWINGS

Generally, the present invention provides a time measurement circuit and a method for measuring time. In accordance with an embodiment the present invention, the time measurement circuit, also referred as a time to digital converter, includes two digital phase counters and a period counter. The first digital phase counter measures a first time interval between a start signal and a leading edge of a clock signal following the start signal. The second digital phase counter measures a second time interval between a stop signal and a leading edge of the clock signal following the stop signal. The period counter measures a third time interval between the two leading edges of the clock signal. The time interval between the start and stop signals is then calculated by taking the difference between the first and second time intervals and adding the result to the third time interval.

Figure 1:
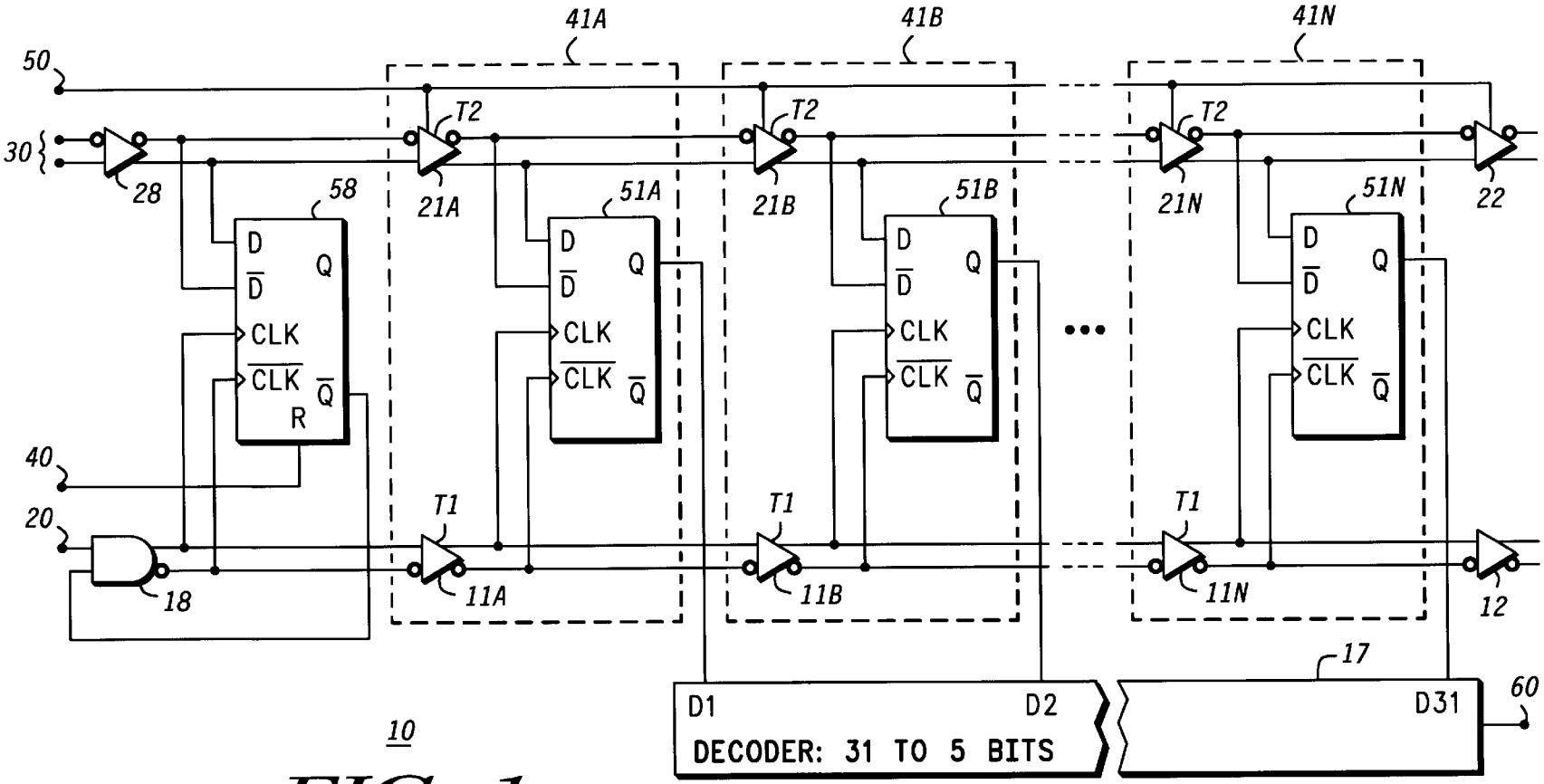
FIG. 1 is a schematic diagram of a time measurement circuit in accordance with a first embodiment of the present invention.

FIG. 1 is a schematic diagram of a time measurement circuit 10 in accordance with a first embodiment of the present invention. In the first embodiment, time measurement circuit 10 is a digital phase counter. Phase counter 10 has a clock input 20 coupled for receiving a clock signal, an event signal input 30 coupled for receiving an event signal, a reset input 40 coupled for receiving a reset signal, a calibration input 50 coupled for receiving a calibration signal, and an output 60 coupled for transmitting a digital output signal. Phase counter 10 includes a decoder 17, a logic gate 18, a delay gate 28, and a resettable storage element 58. In the embodiment illustrated in FIG. 1, logic gate 18 is a logic AND/NAND gate and resettable storage element 58 is a resettable flip-flop. Phase counter 10 further comprises a plurality of serially coupled phase detection elements 41A–41N that generate a digital output signal in response to a time delay between a rising edge of the event signal and a rising edge of the clock signal immediately following the event signal. In the embodiment illustrated in FIG. 1, phase counter 10 includes 31 serially coupled phase detection elements 41A, 41B, . . . , and 41N. Decoder 17 has thirty-one inputs ($D_1$, $D_2$, . . . , and $D_{31}$) and decodes thirty-one logic states into a five bit binary number. The five bit binary number is transmitted through an output port 60 of decoder 17.

It should be understood that, in accordance with the present invention, the number of serially coupled phase detection elements 41A–41N or the number of inputs in decoder 17 in phase counter 10 is not limited to being thirty-one. The dotted line between phase detection elements 41B and 41N represents any number of phase detection elements. In an alternative embodiment, phase counter 10 includes sixty-three phase detection elements 41A–41N in concatenation. Thus, decoder 17 decodes sixty-three logic states to a six bit binary number.

Each phase detection element 41A–41N includes corresponding reference delay gates 11A–11N, programmable delay gates 21A–21N, and storage elements. By way of example, the storage elements 51A–51N are flip-flops. Each reference delay gate 11A–11N has a differentially configured input serving as a first input of its corresponding phase detection element 41A–41N and a differentially configured output serving as a first delay output of its corresponding phase detection element 41A–41N. Each programmable delay gate 21A–21N has a differentially configured input serving as a second input of its corresponding phase detection element 41A–41N, a differentially configured output serving as a second delay output of its corresponding phase detection element 41A–41N, and a calibration input serving as a calibration input of its corresponding phase detection element 41A–41N. The calibration input is used to adjust the delay time between the input and the delay output of programmable delay gates 21A–21N. Each flip-flop 51A–51N has a differentially configured clock input coupled to the differentially configured output of its corresponding reference delay gate 11A–11N, a differentially configured data input coupled to the differentially configured output of its corresponding programmable delay gate 21A–21N, and an output serving as a logic output of its corresponding phase detection element 41A–41N. Although each reference delay gate 11A–11N is described as a delay gate having a fixed delay time (T1) and each programmable delay gate 21A–21N is described as having a programmable delay time (T2), this is not intended as a limitation of the present invention. As long as each delay gate 11A–11N has a delay time (T1) different from a delay time (T2) of each programmable delay gate 21A–21N, the delay gates 11A–11N and 21A–21N can be either delay gates having fixed delay times or delay gates having programmable delay times.

The first delay output of phase detection element 41A is connected to the first input of phase detection element 41B, i.e., the differentially configured input of reference delay gate 11B. The second delay output of phase detection element 41A is connected to the second input of phase detection element 41B, i.e., the differentially configured input of programmable delay gate 21B. The first and second delay outputs of phase detection element 41B are coupled to the first and second inputs of phase detection element 41N, respectively, through serially coupled phase detection elements which are represented by the dashed and dotted lines in FIG. 1. Although three phase detection elements are shown in FIG. 1, it should be noted that there may be less than three phase detection elements. To achieve a uniform operating condition in all phase detection elements 41A–41N, it is desirable to connect the output of reference delay gate 11N to an dummy gate 12 having the same input impedance as. reference delay gates 11A–11N and to connect the output programmable delay gate 21N to a dummy gate 22 having the same input impedance as programmable delay gates 21A–21N. By way of example, dummy gates 12 and 22 are structurally identical to delay gates 11A–11N and 21A–21N, respectively. The logic output of phase detection element 41A, i.e., the true output of flip-flop 51A is connected to a first input ($D_1$) of decoder 17. The logic output of phase detection element 41B, i.e., the true output of flip-flop 51B is connected to a second input ($D_2$) of decoder 17. The logic output of phase detection element 41N, i.e., the true output of flip-flop 51N is connected to a thirty-first input ($D_{31}$) of decoder 17. The calibration input of each phase detection element 41A–41N is connected to a node 50 for receiving a calibration signal.

Logic gate 18 has a first input serving as clock input 20 of phase counter 10 and a differentially configured output connected to a differentially configured clock input of resettable flip-flop 58. Resettable flip-flop 58 has a reset input serving as reset input 40 of phase counter 10 and a complementary output connected to a second input of logic gate 18. Delay gate 28 has a differentially configured input serving as input 30 of phase counter 10 and a differentially configured output connected to a differentially configured data input of resettable flip-flop 58. The differentially configured output of logic gate 18 is connected to the first input of phase delay element 41A, i.e., the differentially configured input of reference delay gate 11A. The differentially configured output of delay gate 28 is connected to the second input of phase detection element 41A, i.e., the differentially configured input of programmable delay gate 21A. The true logic output of each phase detection element 41A–41N is connected to a corresponding input ($D_{1-D31}$) of decoder 17. The output port of decoder 17 serves as output 60 of phase counter 10.

In FIG. 1, all delay gates and flip-flops are illustrated as having differentially configured inputs and outputs. Logic gate 18 is also illustrated as having a differentially configured output. A differentially configured input includes a true input and a complementary input. A differentially configured output includes a true output and a complementary output. Complementary inputs and complementary outputs transmit logic signals complementary to the logic signals transmitted by true inputs and true outputs, respectively. It should be understood that in high frequency applications, digital circuit blocks that are differentially configured are less sensitive to signal degradation than digital circuit blocks that are coupled in a single-ended configuration. However, the present invention is not limited to circuits configured differentially. Phase counter 10 can be in a single-ended configuration. In a single-ended configuration, logic gate 18 performs the function of a logic AND gate. It should also be understood that the circuit blocks having differentially configured inputs or outputs are not limited to those illustrated in FIG. 1. In another example, clock input 20 and reset input 40 are differentially configured inputs coupled for receiving a differential clock signal and a differential reset signal, respectively. In addition, inputs $D_1, D_2, \ldots, D_{31}$ of decoder 17 may be differentially configured for receiving differential logic output signals from the corresponding flip-flops 51A, 51B, . . . , 51N.

Figure 2:
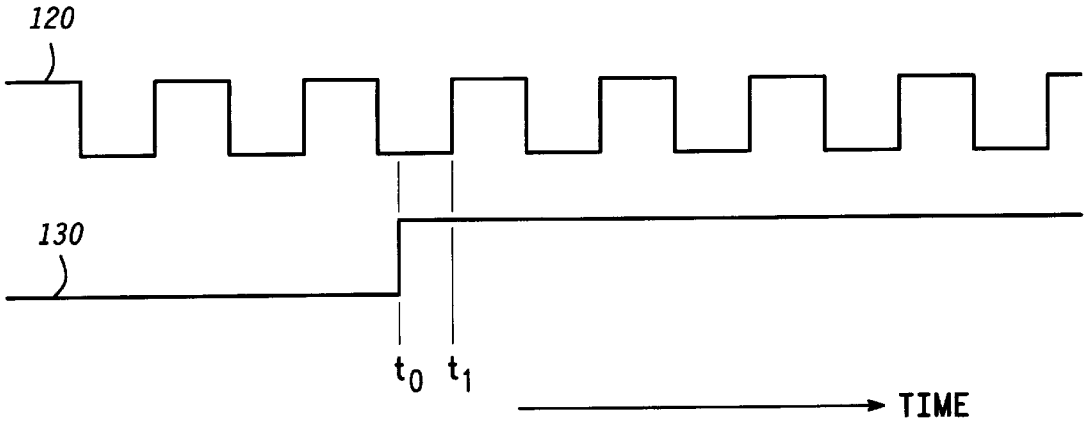
FIG. 2 is a timing diagram of a clock signal and an event signal applied to the time measurement circuit of FIG. 1.

FIG. 2 is a timing diagram for a clock signal 120 and an event signal 130. Clock signal 120 is applied to clock input 20 of phase counter 10 shown in FIG. 1. Event signal 130 is a differential signal applied to differentially configured input 30 of phase counter 10 shown in FIG. 1. For the purpose of simplicity, only one component, e.g., the true component, of event signal 130 is illustrated in FIG. 2. A time $t_0$ represents a rising edge, of event signal 130 and a time $t_1$ represents a rising edge of clock signal 120 immediately following the rising edge of event signal 130.

Phase counter 10 in FIG. 1 measures a time duration from time $t_0$ to time $t_1$. The resolution of the measurement is determined by the number of phase detection elements 41A–41N. More particularly, the resolution is determined by the delay of delay gates 21A–21N relative to the delay of corresponding delay gates 11A–11N, and a number that is greater than the number of phase detection elements 41A–41N by one. For example, a resolution that is thirty-two times as fine as the period of clock signal 120 is achieved by using thirty-one phase detection elements 41A–41N, i.e., one less phase detection element than the desired resolution. This resolution is achieved by setting the adjustable delay time (T2) of programmable delay gates 21A–21N in each phase detection element 41A–41N to be longer than the reference delay time (T1) of reference delay gates 11A–11N by an amount of time equal to the quotient of the period of clock signal 120 and the number thirty-two. The calibration of a programmable delay gate is described in U.S. Pat. No. 5,063,311 entitled "Programmable Time Delay Circuit for Digital Logic Circuits", issued to Mavin C. Swapp on Nov. 5, 1991, and assigned to Motorola, Inc. U.S. Pat. No. 5,063,311 is hereby incorporated herein by reference. By way of example, clock signal 120 has a period of, for example, 320 pico-second (ps). Accordingly, phase counter 10 has a resolution of 10 ps when each programmable delay gate 21A–21N is calibrated to have a delay time (T2) which is 10 ps longer than the reference delay time (T1) of each reference delay gate 11A–11N.

It should be understood that, in accordance with the present invention, the period of clock signal 120 is not limited to being 320 ps and the delay time of each programmable delay gate 21A–21N in excess of that of each reference delay gate 11A–11N is not limited to being 10 ps. The resolution of phase counter 10 is equal to the delay time of each programmable delay gate 21A–21N in excess of that of each reference delay gate 11A–11N. It should be noted that the resolution of phase counter 10 has an upper limit equal to the period of clock signal 120 divided by a number that is greater than the number of phase detection elements 41A–41N by one. Therefore, the delay time (T2) of each programmable delay gate 21A–21N in excess of that of each reference delay gate 11A–11N (T1) has a lower limit equal to the period of clock signal 120 divided by a number that is greater than the number of phase detection elements 41A–41N by one.

In operation, resettable flip-flop 58 is first reset to a logic low state by applying a reset signal to reset input 40. Resetting resettable flip-flop 58 places a logic high voltage level at the complementary output of resettable flip-flop 58, which is transmitted to the second input of logic gate 18. Clock signal 120 is applied at clock input 20 and transmitted through logic gate 18 to the clock input of resettable flip-flop 58. Before time $t_0$, resettable flip-flop 58 is at the logic low state.

At time $t_0$, a rising edge of event signal 130 reaches the data input of resettable flip-flop 58 via delay gate 28. At time $t_1$, the first rising edge of clock signal 120 following the rising edge of event signal 130 reaches the clock input of resettable flip-flop 58, resulting in resettable flip-flop 58 switching to a logic high state. A logic low voltage level appearing at the complementary output of resettable flip-flop 58 is transmitted to the second input of logic gate 18, resulting in a logic low voltage level appearing at the true output of logic gate 18. The rising edge of event signal 130 and the first rising edge of clock signal 120 following the rising edge of event signal 130 continue to propagate through phase detection elements 41A–41N.

If time $t_0$ occurs less than 10 ps before time $t_1$, the rising edge of event signal 130 will reach the data input of flip-flop 51A after the rising edge of clock signal 120 reaches the clock input of flip-flop 51A because the delay time of programmable delay gate 21A is 10 ps longer than that of reference delay gate 11A. Flip-flop 51A is therefore set to a logic low state. Thus, a logic low voltage level appears at the true output of flip-flop 51A and is transmitted to the first input ($D_1$) of decoder 17. The rising edge of event signal 130 falls further behind the first rising edge of clock signal 120 as they continue to propagate through phase detection elements 41B–41N. Thus, flip-flops 51B—51N of respective phase detection elements 41B–41N are also set to logic low states, resulting in logic low voltage levels being transmitted from the true outputs of flip-flops 51B–51N to corresponding inputs $D_2$–$D_{31}$ of decoder 17. With all of its inputs ($D_1$–$D_{31}$) at a logic low voltage level, decoder 17 generates a phase count of zero in a five bit binary number format (00000) at output 60, indicating that the time interval from time $t_0$ to time $t_1$ is less than 10 ps.

If time $t_0$ occurs more than 20 ps but less than 30 ps before time $t_1$, the rising edge of event signal 130 will reach the data input of flip-flop 51A more than 10 ps but less than 20 ps before the rising edge of clock signal 120 reaches the clock input of flip-flop 51A because the delay time of programmable delay gate 21A is 10 ps longer than that of reference delay gate 11A. Flip-flop 51A is therefore set to a logic high state, resulting in a logic high voltage level being transmitted to the first input ($D_1$) of decoder 17. Likewise, the rising edge of event signal 130 will reach the data input of flip-flop 51B less than 10 ps before the rising edge of clock signal 120 reaches the clock input of flip-flop 51B because the delay time of programmable delay gate 21B is 10 ps longer than that of reference delay gate 11B. Flip-flop 51B is therefore set to a logic high state, resulting in a logic high voltage level being transmitted to the second input ($D_2$) of decoder 17. The rising edge of event signal 130 falls behind the rising edge of clock signal 120 as they propagate through the phase detection elements serially coupled to phase detection element 41B. Thus, flip-flops of the corresponding phase detection elements are set to logic low states, resulting in logic low voltage levels being transmitted to the corresponding inputs of decoder 17. Since the first two inputs ($D_1$ and $D_2$) are at a logic high voltage level and next twenty-nine inputs are at a logic low voltage level, decoder 17 generates a digital value of two in a five bit binary number format (00010) at output 60, indicating that the time interval from time $t_0$ to time $t_1$ is more than 20 ps but less than 30 ps.

For other time differences between the rising edge of event signal 130 and the first rising edge of clock signal 120 following the rising edge of event signal 130, phase counter 10 measures the time differences in a way similar to what is described in the two examples cited supra. The results of the measurement are determined by the number of inputs of decoder 17 at the logic high voltage level.

It should be understood that resettable flip-flop 58 and flip-flops 51A–51N of phase detection elements 41A–41N are not limited to being rising edge triggered as described supra. If resettable flip-flop 58 and flip-flops 51A–51N of phase detection elements 41A–41N are falling edge triggered, phase counter 10 measures a time interval between a rising edge of event signal 130 and the first falling edge of clock signal 120 following the event signal. Furthermore, decoder 17 is not limited to decoding thirty-one logic states into a five bit binary format. In an alternative embodiment, decoder 17 decodes thirty-one logic states into a decimal number and output 60 is a visual display that displays the results of the measurement.

Figure 3:
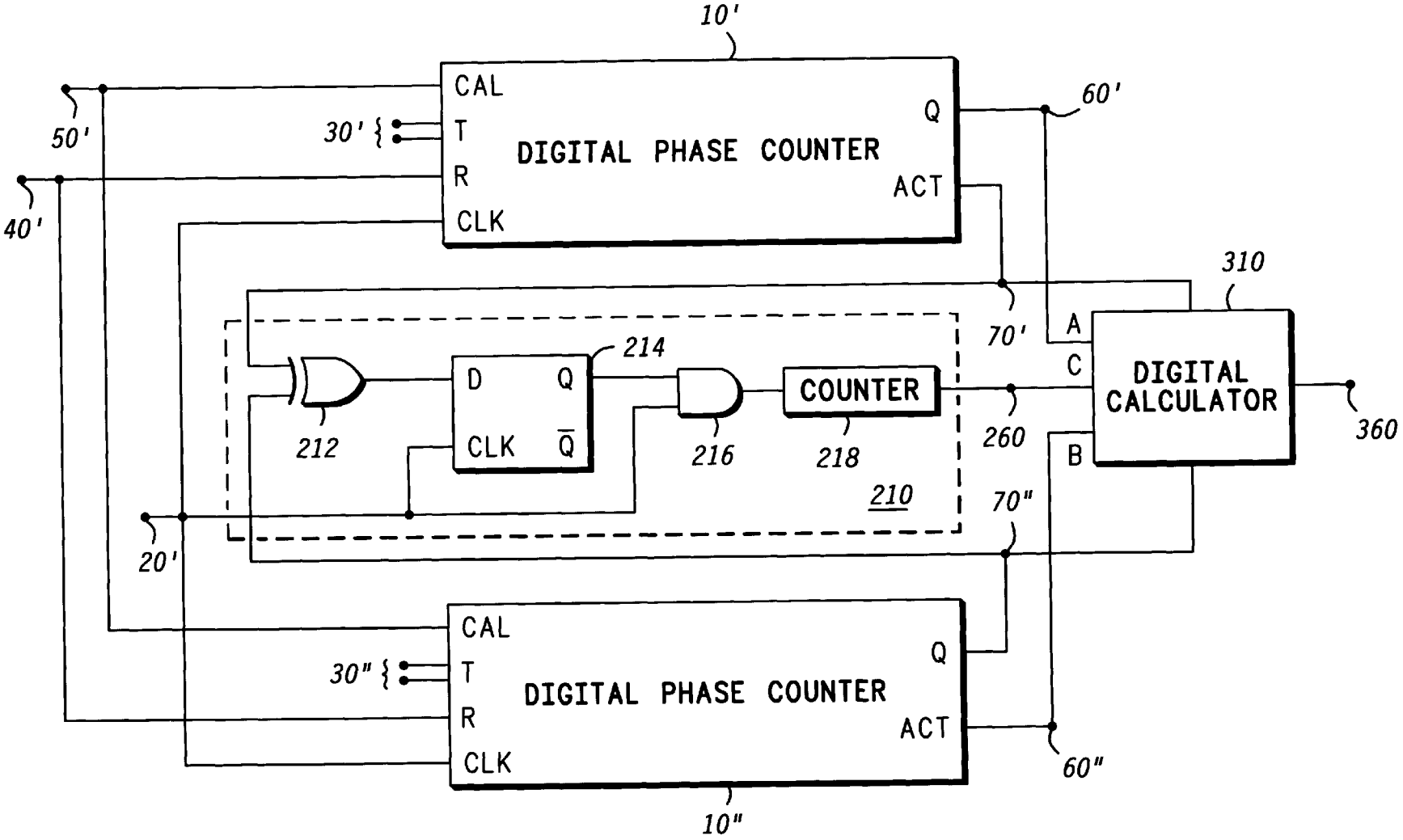
FIG. 3 is a schematic diagram of a time measurement circuit in accordance with a second embodiment of the present invention.

FIG. 3 is a schematic diagram of a time measurement circuit 100 in accordance with a second embodiment of the present invention. In the second embodiment, time measurement circuit 100 is a time to digital converter. Time measurement circuit 100 has a clock input 20' coupled for receiving a clock signal, a first event signal input 30' coupled for receiving a first event signal, e.g., a start signal, a second event signal input 30" coupled for receiving a second event signal, e.g., a stop signal, a reset input 40' coupled for receiving a reset signal, a calibration input 50' coupled for receiving a calibration signal, and an output 360 coupled for transmitting a digital output signal. Time measurement circuit 100 includes a period counter 210, a digital calculator 310, and two digital phase counters, 10' and 10". Although digital phase counters 10' and 10" can serve as time measurement circuits, they are referred to as phase counters with reference to FIGS. 3 and 4 to prevent confusing them with time measurement circuit 100.

Phase counters 10' and 10" are structurally identical to phase counter 10 of FIG. 1. It should be understood that the same reference numerals are used in the figures to denote the same elements. It should be noted that primes (') and double primes (") are included in reference numerals in FIGS. 3 and 4 to denote elements that are common to FIG. 1, but are coupled differently. A clock input (CLK) of phase counter 10' and a clock input (CLK) of phase counter 10" are connected to clock input 20' of time measurement circuit 100. An input (T) of phase counter 10' serves as first input 30' of time measurement circuit 100. An input (T) of phase counter 10" serves as second input 30" of time measurement circuit 100. A reset input (R) of phase counter 10' and a reset input (R) of phase counter 10" are connected together to form reset input 40' of time measurement circuit 100. Calibration inputs (CAL) of phase counter 10' and phase counter 10" are connected together to form calibration input 50' of time measurement circuit 100.

Period counter 210 has a clock input connected to clock input 20' of time measurement circuit 100, a first activation input connected to an activation output 70' (ACT) of phase counter 10', and a second activation input connected to an activation output 70" (ACT) of phase counter 10". The true outputs of the resettable flip-flops (not shown) in phase counter 10' and phase counter 10" serve as activation outputs (ACT) 70' and 70", respectively. Period counter 210 includes an EXCLUSIVE-OR gate 212, a flip-flop 214, an AND gate 216, and a counter 218. EXCLUSIVE-OR gate 212 has a first input serving as the first activation input of period counter 210 and a second input serving as the second activation input of period counter 210. Flip-flop 214 has a clock input serving as the clock input of period counter 210 and a data input connected to an output of EXCLUSIVE-OR gate 212. AND gate 216 has a first input connected to a true output of flip-flop 214 and a second input connected to the clock input of flip-flop 214. Counter 218 has an input connected to an output of AND gate 216 and an output serving as output 260 of period counter 210.

Digital calculator 310 of time measurement circuit 100 has a first input port (A) connected to output 60' (Q) of phase counter 10', a second port (B) connected to output 60" (Q) of phase counter 10", a third input port (C) connected to output 260 of period counter 210, and an output port serving as output 360 of time measurement circuit 100. A first activation input of digital calculator 310 is coupled to activation output 70' of phase counter 10' and a second activation input of digital calculator 310 is coupled to activation output 70" of phase counter 10".

It should be understood that activation output 70' of phase counter 10' is not limited to being represented by the true output of resettable flip-flop 58 of phase counter 10'. In an alternative embodiment, activation output 70' is represented by the complementary output of resettable flip-flop 58 of phase counter 10'. It should be noted that phase counter 10" has the same structure as phase counter 10'. Therefore, the relationship between activation output 70' and the internal components of phase counter 10' is the same as that between activation output 70" and the internal components of phase counter 10".

Figure 4:
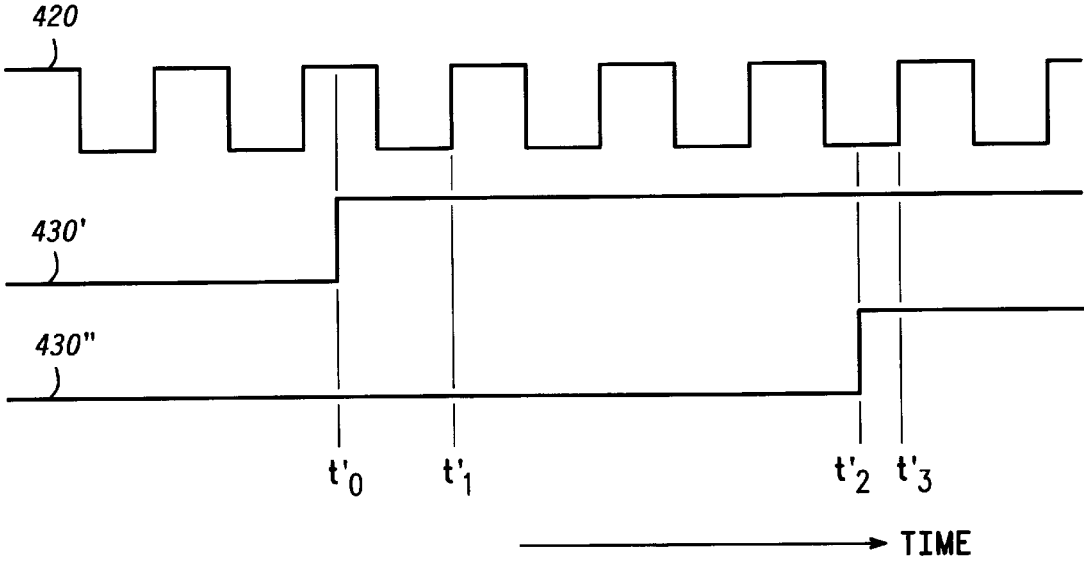
FIG. 4 is a timing diagram of clock, start, and stop signals applied to the time measurement circuit of FIG. 3.

FIG. 4 is a timing diagram for a clock signal 420 having a period of, for example, 320 pico-second (ps), a start signal 430', and a stop signal 430". Clock signal 420 is applied to clock input 20' of time measurement circuit 100 shown in FIG. 3. Start signal 430' is a differential signal applied to differentially configured input 30' of time measurement circuit 100 shown in FIG. 3. Stop signal 430' is a differential signal applied to differentially configured input 30" of time measurement circuit 100 shown in FIG. 3. For the purpose of simplicity, only the true components of start signal 430' and stop signal 430" are illustrated in FIG. 4. A rising edge of start signal 430' occurs at time $t_0'$. The first rising edge of clock signal 420 following the rising edge of start signal 430' occurs at a time $t_1'$. A rising edge of stop signal 430" occurs at a time $t_2'$. The first rising edge of clock signal 420 following the rising edge of stop signal 430" occurs at a time $t_3'$.

Time measurement circuit 100 measures a time interval between two signals. Before a measurement starts, a reset signal is applied to reset input 40'. The reset signal is transmitted to the reset input of phase counter 10', to the reset input of phase counter 10", and to counter 218 of period counter 210. Upon receiving the reset signal, counter 218 is reset to zero and ready to count the number of pulses transmitted to its input. Phase counters 10' and 10" generate a logic low voltage level at activation outputs 70' and 70", respectively. The logic low voltage levels at activation outputs 70' and 70" are transmitted to the first and second inputs of EXCLUSIVE-OR gate 212, respectively. Thus, EXCLUSIVE-OR gate 212 sends a logic low signal to the data input of flip-flop 214, resulting in a logic low voltage level appearing at the true output of flip-flop 214 when a rising edge of clock signal 420 reaches the clock input of flip-flop 214. The logic low voltage level at the true output of flip-flop 214 is transmitted to the second input of AND gate 216 and sets the input of counter 218 to a logic low voltage level, thereby disabling counter 218.

At time $t_0'$, a rising edge of start signal 430' reaches input 30' of time measurement circuit 100. At time $t_1'$, the first rising edge of clock signal 420 following the rising edge of start signal 430' reaches clock input 20' of time measurement circuit 100. Phase counter 10' generates a first phase count representing a time interval between time $t_0'$ and time $t_1'$ in the same way as phase counter 10 of FIG. 1 measures the time interval between time $t_0$ and time $t_1$ of FIG. 2.

At time $t_2'$, a rising edge of stop signal 430" reaches input 30" of time measurement circuit 100. At time $t_3'$, the first rising edge of clock signal 420 following the rising edge of stop signal 430" reaches clock input 20' of time measurement circuit 100. Phase counter 10" generates a second phase count representing a time interval between time $t_2'$ and time $t_3'$ in the same way as phase counter 10 of FIG. 1 measures the time interval between time $t_0$ and time $t_1$ of FIG. 2.

At time $t_1'$, the first rising edge of clock signal 420 following start signal 430' causes a logic high voltage to appear at activation output 70' of phase counter 10'. Between time $t_1'$ and time $t_3'$, the first and second inputs of EXCLUSIVE-OR gate 212 are at a logic high voltage level and a logic low voltage level, respectively. Thus, EXCLUSIVE-OR gate 212 generates a logic high voltage level at the data input of flip-flop 214, resulting in flip-flop 214 switching to a logic high state at the first rising edge of clock signal 420 following the rising edge of start signal 430'. The true output of flip-flop 214 transmits the logic high voltage level to the first input of AND gate 216. Therefore, the logic state at the output of AND gate 216 is identical to clock signal 420 appearing at the second input of AND gate 216. Counter 218, upon receiving clock signal 420 via AND gate 216, starts to count the rising edges of clock signal 420.

At time $t_3'$, the first rising edge of clock signal 420 following stop signal 430" causes a logic high voltage to appear at activation output 70" of phase counter 10". A logic high voltage levels appears at both inputs of EXCLUSIVE-OR gate 212, generating a logic low voltage level at the data input of flip-flop 214. Thus, a logic low voltage level appears at the true output of flip-flop 214 when the first rising edge of clock signal 420 following the rising edge of stop signal 430" reaches the clock input of flip-flop 214. The logic low voltage level at the true output of flip-flop 214 is transmitted to the second input of AND gate 216 and sets the input of counter 218 to a logic low voltage level, which in turn stops counting.

If the rising edge of start signal 430' arrives at input 30' and the rising edge of stop signal 430" arrives at input 30" of digital converter 100, respectively, within two adjacent rising edges of clock signal 420, the first rising edge of clock signal 420 following the rising edge of start signal 430' is also the first rising edge of clock signal 420 following the rising edge of stop signal 430". Thus, time $t_1'$ is the same as time $t_3'$. Under this condition, the two inputs of EXCLUSIVE-OR gate 212 switch from a logic low voltage level to a logic high voltage level simultaneously. Therefore, the output of EXCLUSIVE-OR gate 212 stays at a logic low voltage level. The true output of flip-flop 214 and the output of AND gate 216 also remain at logic low voltage levels, resulting in counter 218 remaining inactive.

Throughout the process, counter 218 generates a period count of the number of pulses of clock signal 420 from time $t_1'$ to time $t_3'$. The product of the period count and the period of clock signal 420 equals the time interval between time $t_1'$ and time $t_3'$. The period count is transmitted to output 260 of period counter 210 in a binary number format.

After receiving activation signals from activation output 70' of phase counter 10' and from activation output 70" of phase counter 10", digital calculator 310 combines the first phase count (A) received from output 60' of phase counter 10' via the first input port, the second phase count (B) received from output 60" of phase counter 10" via the second input port, and the period count (C) received from output 260 of period counter 210 via the third input port to generate a time count at output 360 of time measurement circuit 100. The time count represents a time interval between time $t_0'$ and time $t_2'$. In the example cited supra, each increment of the first phase count (A) and the second phase count (B) represents a time interval equal to the resolution of phase counter 10' and 10", i.e., 10 ps, and each increment in the period count (C) represents a time interval equal to the period of clock signal 420, i.e., 320 ps. Therefore, the time count represents a time interval equal to (320C+10A–10B) ps between time $t_0'$ and time $t_2'$. It should be understood that the format of the output of time measurement circuit 100 is not limited to a binary format. In one example, the time count is converted to a decimal number and output 360 of time measurement circuit 100 is a visual display that displays the result of the measurement.

The result of the measurement by time measurement circuit 100 is determined by, among other factors, the difference between the time interval from the rising edge of start signal 430' to the first rising edge of clock signal 420 following the rising edge of start signal 430' and the time interval from the rising edge of stop signal 430" to the first rising edge of the clock signal 420 following the rising edge of stop signal 430". Therefore, the actual delay times of logic gate 18 and delay gate 28 of phase counter 10' are inconsequential to the time measurement result as long as phase counter 10" is the same as phase counter 10'.

By now it should be appreciated that a circuit and a method for measuring time have been provided, wherein the resolution of the measurement is finer than the period of a clock signal used in the measurement. A circuit in accordance with the present invention can be used to simulate a clock with a frequency higher than that of the clock signal supplied to the circuit or to simulate a high speed counter. The present invention is applicable not only in the area of high precision time measurement, but also in the area of low power circuitry. A circuit in accordance with the present invention can use a low frequency clock signal source to perform a function which otherwise requires a high frequency clock signal source. As those skilled in the art are aware, low frequency clock signal sources usually consume less power than high frequency clock signal sources. Furthermore, present invention provides a circuit that is fast, accurate, simple, and inexpensive compared with prior art circuits. In addition, the present invention provides a time measurement circuit that can be manufactured as a monolithic integrated circuit.

What is claimed is:

1. A method for measuring time, comprising the steps of:

generating a clock signal comprised of a series of pulses, each pulse in the series of pulses having an edge;

generating a first signal having an edge;

identifying a first pulse in the series of pulses, an edge of the first pulse being chronologically behind the edge of the first signal;

delaying the edge of the first pulse at least once by a first reference delay time;

delaying the edge of the first signal at least once by a first delay time, the first delay time being longer than the first reference delay time; and generating a first phase count equal to a number of times for which the edge of the first pulse occurring after a step of delaying the edge of the first pulse is chronologically behind the edge of the first signal occurring after a corresponding step of delaying the edge of the first signal.

2. The method as claimed in claim 1, further comprising the steps of:

generating a second signal having an edge chronologically behind the edge of the first signal;

identifying a second pulse in the series of pulses, an edge of the second pulse being chronologically behind the edge of the second signal;

delaying the edge of the second pulse at least once by a second reference delay time;

delaying the edge of the second signal at least once by a second delay time, the second delay time being longer than the second reference delay time; and generating a second phase count equal to a number of times for which the edge of the second pulse occurring after a step of delaying the edge of the second pulse is chronologically behind the edge of the second signal occurring after a corresponding step of delaying the edge of the second signal.

3. The method as claimed in claim 2, further comprising the steps of:

setting the second reference delay time to be substantially equal to the first reference delay time; and setting the second delay time to be substantially equal to the first delay time.

4. The method as claimed in claim 3, wherein the step of generating a time count includes generating the time count in a binary format.

5. The method as claimed in claim 1, wherein:

the step of delaying the edge of the first pulse at least once includes delaying the edge of the first pulse a first number of times; and the step of delaying the edge of the first signal at least once includes delaying the edge of the first signal the first number of times.

6. The method as claimed in claim 5, wherein:

the step of generating a clock signal includes generating the clock signal having a period; and the steps of delaying the edge of the first pulse and delaying the edge of the first signal include setting a difference between the first delay time and the first reference delay time substantially equal to or greater than the period of the clock signal divided by a sum of the first number and one.

7. The method as claimed in claim 2, further comprising the step of generating a period count by counting a number of pulses in the series of pulses of the clock signal from the first pulse to the second pulse.

8. The method as claimed in claim 7, further comprising the step generating a time count by combining the first phase count, the second phase count, and the period count.

9. A counting process, comprising the steps of:

generating a clock signal comprised of a plurality of edges;

generating a first signal;

identifying a first edge in the plurality of edges of the clock signal, the first edge being chronologically behind the first signal;

delaying the first edge at least once by a first reference time;

delaying the first signal at least once by a first delay time, the first delay time being longer than the first reference time; and generating a first phase count equal to a number of times for which the first edge occurring after a step of delaying the first edge is chronologically behind the first signal occurring after a corresponding step of delaying the first signal.

10. The counting process as claimed in claim 9, wherein:

the step of delaying the first edge at least once includes delaying the first edge N times, N being an integer; and the step of delaying the first signal at least once includes delaying the first signal N times.

11. The counting process as claimed in claim 10, wherein:

the step of generating a clock signal includes generating the clock signal having a period; and the steps of delaying the first edge and delaying the first signal include setting a difference between the first delay time and the first reference time substantially equal to or greater than the period of the clock signal divided by (N+1).

12. The counting process as claimed in claim 9, further comprising the steps of:

generating a second signal chronologically behind the first signal;

identifying a second edge in the plurality of edges of the clock signal, the second edge being chronologically behind the second signal;

delaying the second edge at least once by a second reference time;

delaying the second signal at least once by a second delay time, the second delay time being longer than the second reference time; and generating a second phase count equal to a number of times for which the second edge occurring after a step of delaying the second edge is chronologically behind the second signal occurring after a corresponding step of delaying the second signal.

13. The counting process as claimed in claim 12, further comprising the steps of:

setting the second reference time to be substantially equal to the first reference time;

setting the second delay time to be substantially equal to the first delay time; and subtracting the second phase count from the first phase count to generate a difference count.

14. The counting process as claimed in claim 13, further comprising the step of generating a period count by counting a number of edges in the plurality of edges of the clock signal from the first edge to the second edge.

15. The counting process as claimed in claim 14, further comprising the step generating a time count by combining the difference count and the period count.

16. A method for measuring time, comprising the steps of:

generating a clock signal having a period and comprised of a plurality of pulses, each pulse in the plurality of pulses having an edge;

generating a first signal having an edge;

identifying a first pulse in the plurality of pulses, an edge of the first pulse being chronologically behind the edge of the first signal;

successively delaying the edge of the first pulse by a reference time for a predetermined number of times;

successively delaying the edge of the first signal by a delay time for the predetermined number of times, the delay time being longer than the reference time;

comparing the edge of the first pulse, which occurs after each step of delaying the edge of the first pulse by the reference time, with the edge of the first signal, which occurs after a corresponding step of delaying the edge of the first signal by the delay time; and generating a first phase count equal to a number of times for which the edge of the first pulse occurring after a step of delaying the edge of the first pulse is chronologically behind the edge of the first signal occurring after a corresponding step of delaying the edge of the first signal.

17. The method as claimed in claim 16, further comprising the steps of:

generating a second signal having an edge chronologically behind the edge of the first signal;

identifying a second pulse in the plurality of pulses of the clock signal, an edge of the second pulse being chronologically behind the edge of the second signal;

successively delaying the edge of the second pulse by the reference time for the predetermined number of times;

successively delaying the edge of the second signal by the delay time for the predetermined number of times;

comparing the edge of the second pulse, which occurs after each step of delaying the edge of the second pulse by the reference time, with the edge of the second signal, which occurs after a corresponding step of delaying the edge of the second signal by the delay time;

generating a second phase count equal to a number of times for which the edge of the second pulse occurring after a step of delaying the edge of the second pulse is chronologically behind the edge of the second signal occurring after a corresponding step of delaying the edge of the second signal;

generating a period count by counting a number of pulses in the plurality of pulses of the clock signal from the first pulse to second pulse; and generating a time count by combining the first phase count, the second phase count, and the period count.

18. The method as claimed in claim 17, wherein the steps of successively delaying the edge of the first pulse and successively delaying the edge of the first signal include setting a difference between the delay time and the reference time to a resolution time substantially equal to the period of the clock signal divided a sum of the predetermined number and one.

19. The method as claimed in claim 18, wherein the step of generating a time count further includes the step of generating a difference count by subtracting the second phase count from the first phase count.

20. The method as claimed in claim 19, wherein the step of generating a time count further includes the step of substantially equating a time interval between the edge of the first signal and the edge of the second signal to a sum of the period of the clock signal multiplied by the period count and the resolution time multiplied by the difference count.

* * * * *